252-99 AU 113 EX
9/22/87 XR 4,695,394

United States Patent [19]
Choy et al.

[11] Patent Number: 4,695,394
[45] **Date of Patent: * Sep. 22, 1987**

[54] THICKENED AQUEOUS CLEANSER

[75] Inventors: Clement K. Choy, Walnut Creek; Frederick I. Keen, Manteca; Aram Garabedian, Newark; Colleen J. Spurgeon, Walnut Creek, all of Calif.

[73] Assignee: The Clorox Company, Oakland, Calif.

[ * ] Notice: The portion of the term of this patent subsequent to Jul. 8, 2003 has been disclaimed.

[21] Appl. No.: 739,377

[22] Filed: May 30, 1985

Related U.S. Application Data

[63] Continuation-in-part of Ser. No. 727,702, Apr. 26, 1985, which is a continuation of Ser. No. 603,266, Apr. 20, 1984, Pat. No. 4,599,186.

[51] Int. Cl.[4] ..... C11D 9/20; C11D 9/12; C11D 3/395

[52] U.S. Cl. ..... 252/97; 252/95; 252/98; 252/99; 252/112; 252/116; 252/140; 252/102; 252/155; 252/174.25; 252/DIG. 14

[58] Field of Search ..... 252/95, 99, 96, 97, 252/103, 140, 155, 174.25, 98, 102; 51/304, 308

[56] References Cited

U.S. PATENT DOCUMENTS

| | | | |
|---|---|---|---|
| 3,149,078 | 9/1964 | Zmoda | 252/99 |
| 3,558,496 | 1/1971 | Zmoda | 252/95 |
| 3,684,722 | 8/1972 | Hyman et al. | 252/98 |
| 4,158,553 | 6/1979 | Chapman | 51/304 |
| 4,229,313 | 10/1980 | Joy | 252/98 |
| 4,240,919 | 12/1980 | Chapman | 252/95 |
| 4,248,728 | 2/1981 | Puryear | 252/103 |
| 4,271,030 | 6/1981 | Brierley et al. | 252/98 |
| 4,337,163 | 6/1982 | Schilp | 252/96 |
| 4,397,755 | 8/1983 | Brierley et al. | 252/113 |
| 4,508,634 | 4/1985 | Elepano et al. | 252/163 |

*Primary Examiner*—Prince E. Willis
*Attorney, Agent, or Firm*—Stephen M. Westbrook; Joel J. Hayashida; John A. Bucher

[57] ABSTRACT

The present invention discloses various embodiments and examples of a thickened aqueous abrasive cleanser capable of maintaining a smoothly flowable or plastic consistency over long periods of time. The cleanser is characterized by the ability to stably suspend abrasives while exhibiting excellent shelf stability over long periods of time with substantially no syneresis and being suitable for use where environmental requirements prevent the use of phosphates. This cleaner has the following ingredients:

(a) a colloidal alumina thickener having an average particle size, in dispersion, of no more than about one micron;
(b) an electrolyte/buffer;
(c) a surfactant system including two surfactant components, one surfactant component comprising a fatty acid anionic surfactant, the other surfactant component comprising a selected bleach-stable surfactant or mixed surfactant;
(d) a bleach; and
(e) a particulate abrasive having an average particle size of about one to as much as 400 microns to provide scouring action.

Methods of use and preparation for the cleansers of the present invention are also set forth.

34 Claims, 2 Drawing Figures

THICKENED AQUEOUS CLEANSER

This is a continuation-in-part of copending U.S. patent application Ser. No. 727,702, filed Apr. 26, 1985 for a THICKENED AQUEOUS ABRASIVE SCOURING CLEANSER, in turn a continuation of Ser. No. 603,266 filed Apr. 20, 1984, now U.S. Pat. No. 4,599,186, both assigned to the assignee of the present invention.

FIELD OF THE INVENTION

The present invention relates to thickened aqueous abrasive cleansers and more particularly to such cleansers which are characterized by a smoothly flowable or plastic consistency.

BACKGROUND OF THE INVENTION

Each of the above references disclosed a thickened aqueous scouring cleanser containing abrasives and a bleach source. The present invention includes certain components and features which are common to the cleansers of the above noted references. Accordingly, portions of the following disclosure are similar to portions of the above noted references.

As was also noted in the above reference, various heavy duty cleansers have been developed in the prior art for removing a variety of soils and stains from hard surfaces. The nature of those heavy duty cleansers is summarized below with respect to prior art references in which representative cleansers are further described.

Initially, U.S. Pat. No. 3,985,668 issued to Hartman, describes a combination of perlite (an expanded silica abrasive) and a colloid-forming clay in combination with a hypochlorite bleach, a surfactant and a buffer with abrasives being suspended in the combination. A clay thickened system of this type tends to set up or harden upon storage due to the false body nature of the thickeners. Such products require shaking before use in order to break down the false body structure and make the product flowable.

Other prior art cleansers have been formulated in an attempt to suspend abrasives using only inorganic colloid thickeners. However, in such products, syneresis has commonly been a problem in that a solids portion of the cleansers has substantially separated from the liquid portion. This layering effect resulting from syneresis not only detracts from the esthetic appearance of the product but also requires that the product be shaken or agitated prior to use in order to achieve uniform dispersion of its cleaning components throughout the composition.

One way of alleviating syneresis problems in the prior art has been through the use of perlite or perlite type material with specified particle sizes as defined in U.S. Pat. No. 3,985,668 issued to Hartman and also noted above.

In addition to the problem of syneresis, it is also necessary to compound such products in order to condition them for maintaining particulate solids such as abrasives in suspension. As is well known in the art, abrasives are commonly employed in such products in order to enhance their ability to scour or clean hard surfaces.

In the prior art, high levels of surfactants have been employed to form a plastic rheology for achieving suspension of abrasives and the like. However, the presence of high levels of surfactants in turn commonly exhibits a detrimental effect on hypochlorite bleach stability. For example, U.S. Pat. No. 4,352,678, issued to Jones et al, disclosed cleanser compositions thickened with mixed surfactants for the purpose of suspending abrasives, the cleansers also incorporating a source of hypochlorite bleach. As disclosed by this particular reference, relatively large amounts of surfactants were incorporated into the cleansers in order to satisfactorily suspend the abrasives. However, the use of relatively large amounts of surfactants had the unfortunate disadvantage of causing poor hypochlorite bleach stability in terms of half-life stability at 50° C. even with relatively low levels of hypochlorite (0.5% sodium hypochlorite initial level).

For the purposes of the present invention and also in accordance with the above noted reference, half-life stability is defined as the amount of time it takes for 50% of the initial amount of bleach present in a given composition to decompose.

Other prior art references have also disclosed cleansers in which clay was used as a thickener and for suspending abrasives. However, such clay-thickened cleansers often have a tendency to set up or harden, often in a relatively short time. At the same time, typical clay-thickened cleansers in the prior art also tend to exhibit significant syneresis problems.

Other related efforts in the prior art include for example U.S. Pat. No. 4,337,163, issued to Schilp, which disclosed a hypochlorite bleach product thickened with a combination of amine oxides and anionic surfactants. However, the thickened bleach product disclosed by Schilp contained neither clay now abrasive particles requiring suspension in the manner disclosed above. Moreover, the high amount of surfactants may lead to hypochlorite stability.

U.S. Pat. No. 3,956,158 (and corresponding British Pat. No. 1,418,671), issued to Donaldson, disclosed an abrasive-containing bleach thickened with insoluble detergent filaments. As was also noted in U.S. Pat. No. 4,352,678, referred to above, compositions such as those disclosed in the Donaldson patent have also exhibited numerous disadvantages, including low detergency and lack of physical and chemical stability at higher temperatures.

In the copending reference initially noted above, a very effective cleanser composition was described and included both abrasives and hypochloride bleach. A creamy or smoothly flowable consistency and plastic rheology resulting in continuously flowable characteristics of the composition resulted from the use of one or more selected surfactants together with hydrated aluminum oxide as a thickener which functioned in combination with an electrolyte/buffer to achieve the desired plastic rheology noted above. At the same time, the composition of the copending reference exhibited minimal or essentially no syneresis or phase separation. Thus, even after relatively long periods of storage, the composition of the copending reference did not require shaking or agitation. Rather, the product was readily pourable and exhibited uniform distribution of its various components throughout the composition.

In connection with the present invention, it was found that certain modifications tended to be necessary in connection with the composition of the copending reference, for example, to satisfy environmental requirements in certain areas prohibiting the use of phosphates in such cleaning products. Replacing phosphates in the cleaning composition with other electrolyte/buffers, particularly silicates, resulted in more thixotropic characteristics. Accordingly, there was found to remain a need for a product similar to that disclosed by the copending reference noted above while satisfying environmental requirements by the absence of phosphates and also exhibiting a consistency similar to the plastic rheology of the copending reference.

It will also be apparent that such a plastic rheology is desirable in a number of other cleanser products in addition to the abrasive containing scouring cleansers of the type disclosed above in order to take advantage of desirable resulting characteristics such as uniform distribution of components and smooth flowing or pourable qualities in products even after they have been standing for relatively long periods of time.

Accordingly, there has been found to remain a need for a thickened aqueous cleanser having a plastic rheology and being capable of use without the need for prior shaking or agitation. At the same time, there has been found to remain a need for thickened hard surface cleansers having characteristics such as those noted above while also being capable of suspending abrasives and/or containing bleaches while exhibiting little or no syneresis over time and also having long-term bleach stability.

SUMMARY OF THE INVENTION

It is therefore an object of the invention to provide a novel, thickened aqueous cleanser characterized by a plastic rheology and a consistency which remains smoothly flowable over long periods of time.

It is a more particular object of the invention, particularly in connection with a preferred embodiment thereof, to provide a hard surface abrasive scouring cleanser comprising:

(a) a colloidal alumina thickener having an average particle size, in dispersion, of no greater than about one micron;
(b) an electrolyte/buffer;
(c) surfactant system including two surfactant components, one surfactant component comprising a fatty acid anionic surfactant in the form of a neutralized fatty acid, commonly termed a "soap", the other surfactant component comprising a selected bleach-stable surfactant or mixed surfactant combination;
(d) a halogen bleach; and
(e) a particulate abrasive having an average particle size of about one to 400 microns to provide scouring action.

The hard surface abrasive scouring cleanser of the present invention as summarized above provides excellent suspension of abrasive particles and excellent bleach stability as well. In addition, the cleanser of the present invention has also been found to surprisingly demonstrate a substantial absence of syneresis. The low or nonexistant levels of syneresis provided by the present invention have also been found to be stable over time and even at relatively elevated temperatures. Because of the resulting physical stability, cleansers provided by the present invention do not require shaking before use in order to fluidize the formulation. Rather, the cleansers maintain a uniform plastic rheology and smoothly flowable consistency even after extended periods of shelf life. Accordingly, the cleansers of the present invention have substantial esthetic appeal while being useful in the sense of being easy to dispense, maintaining solid abrasives and other components in uniform suspension and giving good coverage by flowing down vertical surfaces.

Preferably, the other bleach-stable surfactant component of the present invention as summarized above is selected from the group consisting essentially of anionic, nonionic, amphoteric, zwitterionic surfactants, and mixtures thereof, while even more preferably comprising a mixed surfactant system comprising a bleach-stable nonionic surfactant such as an amine oxide and an anionic surfactant such as a secondary alkane sulfonate.

It is yet a further object of the invention to provide a cleanser of the type summarized above wherein the electrolyte/buffer is a non-phosphate material and even more preferably a silicate based material, the other components of the cleanser interacting with the silicate electrolyte/buffer to form a cleanser having a particularly desirable plastic rheology and smooth flowing consistency over long periods of time.

It is yet another related object of the invention to provide a thickened, aqueous abrasive cleanser characterized by a plastic rheology and a uniform consistency remaining smoothly flowable even over long periods of time, the cleanser comprising:

(a) a colloidal alumina thickener having an average particle size, in dispersion, of no more than about one micron;
(b) an abrasive having an average particle size of about one to 400 microns to provide proper scouring action;
(c) an electrolyte/buffer; and
(d) a fatty acid anionic surfactant.

In the combination of the cleanser set forth immediately above, the colloidal alumina thickener and the fatty acid anionic surfactant have been found to interact to an unexpected degree to develop a uniform plastic rheology for the composition.

The composition summarized immediately above has been found to be particularly effective in combination with a non-phosphate electrolyte/buffer. For example, such electrolyte/buffer materials may be selected from the group consisting essentially of: silicates, metasilicates, polysilicates, carbonates, hydroxides; the alkali metal salts thereof; and mixtures thereof.

Also within the composition summarized immediately above, the colloidal alumina thickener is characterized by small particle size in dispersion, generally less than about one micron and even more preferably having a particle size of no more than about 0.5 microns.

It is also preferred in connection with the composition of the present invention as summarized immediately above that the fatty acid anionic surfactant comprise a soap such as a saturated or unsaturated, straight or branched alkyl chain fatty acid and mixtures thereof. Even more preferably, the fatty acid anionic surfactant is selected to have a molecular weight characterized by approximately six to twenty-two carbon groups, more preferably about eight to eighteen carbon groups and even more preferably about ten to fourteen carbon groups. One preferred embodiment of the present invention, as described in greater detail below, employs a fatty acid anionic surfactant including twelve carbon groups. It is also preferred in accordance with the present invention that the fatty acid anionic surfactant be monovalent.

It is still a further object of the present invention to provide a thickened aqueous cleanser having a halogen bleach incorporated therein and being characterized by a plastic rheology and a uniform consistency remaining smoothly flowable, the cleanser comprising:

(a) an inorganic colloid, such as alumina with an average particle size of no more than about one micron or certain clays, for thickening the cleanser;
(b) a halogen bleach;
(c) a fatty acid anionic surfactant; and
(d) an electrolyte/buffer to promote the environment in which the inorganic colloid and fatty acid surfactant can associate to provide proper rheology.

The present invention has surprisingly demonstrated the ability of the inorganic colloid and fatty acid surfactant to provide unexpectedly good plastic rheology and a uniform smoothly flowable consistency in a cleanser also containing a halogen bleach.

Other related objects of the present invention comprise a method of cleaning hard surfaces employing cleansers of the type summarized above as well as a method for preparing such cleansers.

Additional objects and advantages of the invention are made more apparent in the following description and examples of the invention which, however, are not to be taken as limiting the scope of the invention.

DESCRIPTION OF THE PREFERRED EMBODIMENTS

Figure 1:
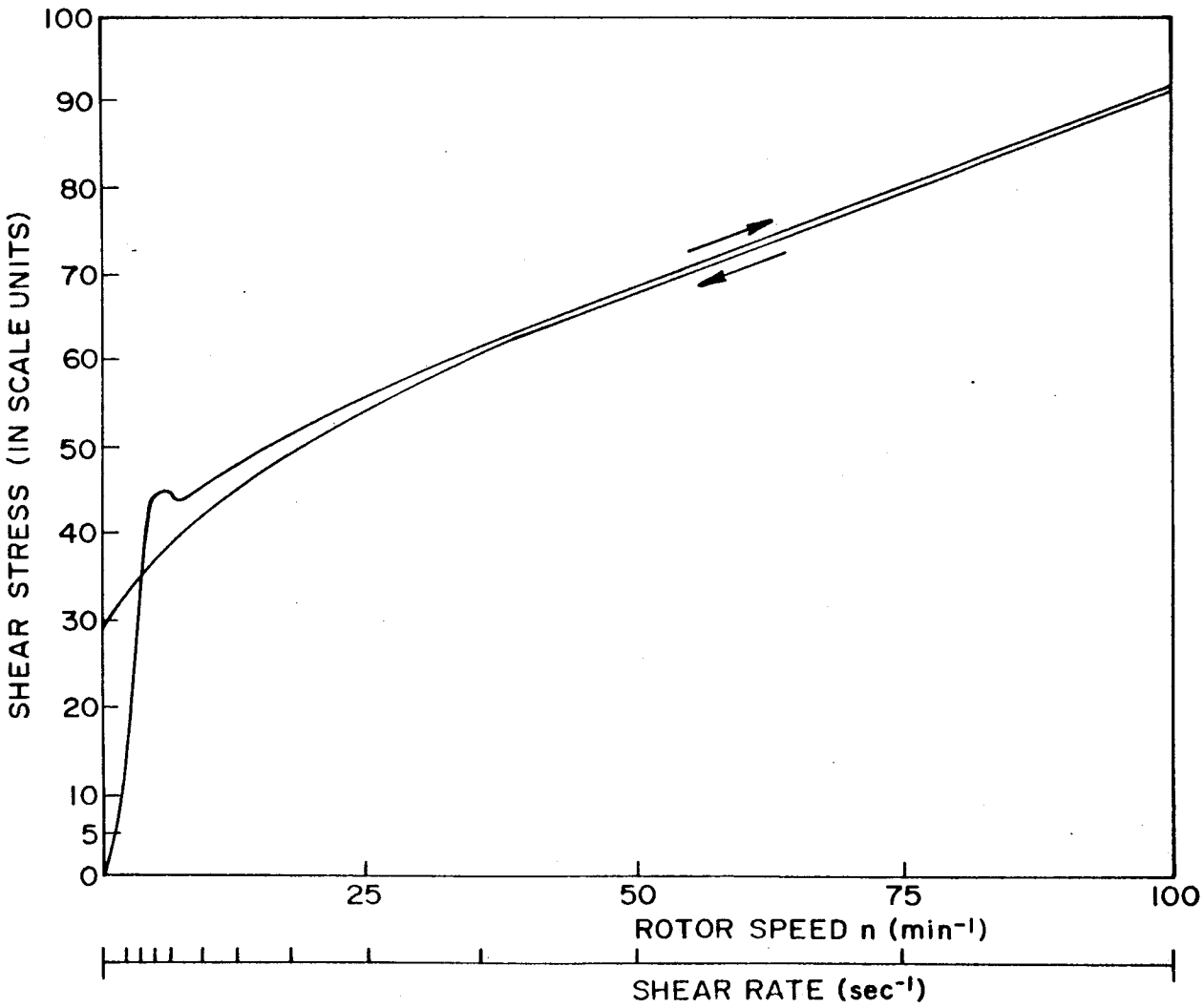
FIG. 1 of the patent drawings is a rheogram from a typical formulation exhibiting good plastic rheology and a selected yield value making it suitable for suspending an abrasive component, in accordance with the present invention.

The present invention provides a thickened, aqueous cleanser characterized by a plastic rheology and a smoothly flowable consistency, these characteristics being retained by the cleanser even over long periods of time. More preferably, the invention relates to a hard surface abrasive scouring cleanser having properties of the type described above while also exhibiting little or no significant syneresis, stably suspending abrasive solids and demonstrating very limited decomposition of bleach as measured by bleach half-life stability.

In various embodiments of the invention as disclosed below, the cleanser has been made environmentally acceptable particularly through the selection of a non-phosphate electrolyte/buffer. Preferably, the electrolyte/buffer of the invention is selected from a class of non-phosphate materials, more preferably silicate based materials including silicates, metasilicates and polysilicates as well as other silicate variations described in greater detail below.

In connection with an environmentally acceptable cleanser of the type referred to immediately above and including both colloidal alumina as a thickener and a non-phosphate electrolyte/buffer such as a silicate based material, there has been found to result substantial thixotropic characteristics apparently through an interaction between the colloidal alumina thickener and the electrolyte/buffer. The present invention has eliminated this thixotropic characteristic and replaced it with a plastic rheology and smooth flowing consistency through the combination of a fatty acid anionic surfactant in combination with the colloidal alumina thickener and the electrolyte/buffer. Such a combination has been found to provide a particularly suitable base for a broad range of cleansers having the desirable characteristics of a thickened, aqueous composition characterized by a plastic rheology and a smooth flowing consistency, those characteristics being maintained by the composition even over long periods of storage. In particular, such composition may provide a basis for the formation of a scouring cleanser by the addition of abrasive solids which are effectively maintained in suspension by the composition.

A bleach may also be added to the composition with the abrasive solids to further enhance its cleaning ability. Even further, other surfactants in addition to the fatty acid anionic surfactant may be included in the composition to further enhance various characteristics of the cleanser such as its plastic rheology and more particularly to minimize or substantially eliminate syneresis effects. Without a bleach being present in the cleanser, any amount of the surfactant could be included in the composition. However, even with a bleach included in the composition, desirable characteristics such as a plastic rheology and a smooth flowing consistency with little or no syneresis and acceptable long-term bleach stability can be achieved since very small amounts of additional surfactants are necessary in combination with the colloidal alumina thickener and the fatty acid anionic surfactant. These features of the invention are made more apparent in the following description and examples.

Accordingly, in at least one embodiment of the invention, a thickened, aqueous cleanser having desirable characteristics of a plastic rheology and smooth flowing consistency, while more preferably being embodied as a hard surface scouring cleanser containing abrasives, comprises:

(a) a colloidal alumina thickener having an average particle size, in dispersion, of no more than about one micron;
(b) an electrolyte/buffer, which is preferably non-phosphate for environmental reasons and more preferably a silicate based material to promote an environment in which the colloidal thickener and surfactant system can associate to provide a desired rheology;
(c) a surfactant system including two surfactant components, one surfactant component comprising a fatty acid anionic surfactant, the other surfactant component comprising a selected bleach-stable surfactant or mixed surfactant combination;
(d) a halogen bleach; and
(e) a particulate abrasive having an average particle size of about one to 400 microns to provide scouring action.

Essential ingredients in the composition of the invention as summarized above particularly include the colloidal alumina thickener and a surfactant. Particularly where the colloidal alumina thickener tends to demonstrate thixotropic characteristics upon combination with an electrolyte/buffer such as a non-phosphate material and more preferably a silicate based material, the surfactant is selected as a fatty acid anionic surfactant according to the present invention. As was noted above and is made more apparent below, a combination of surfactants is preferably included within the composition.

In order to provide a more complete understanding of the invention, a summary as to each of the individual components in the composition of the present invention is set forth in greater detail below.

COLLOIDAL ALUMINA THICKENER

The colloidal alumina thickener component of the present invention is preferably a hydrated aluminum oxide having qualifying characteristics such as particle size to cause it to function as a colloidal thickener. In this sense, the colloidal alumina thickener of the invention is to be contrasted from abrasive alumina materials having substantially larger particle sizes, for example substantially greater than one micron. Accordingly, the particle size of the colloidal alumina thickener is a particularly important feature for that component of the invention.

Preferred hydrated aluminas within the present invention are derived from synthetic Boehmites. Of greater importance, the hydrated colloidal alumina thickener of the present invention is chemically insoluble, that is, it should not dissolve in reasonably acidic, basic or neutral media. However, it is noted that colloidal alumina will dissolve in strongly alkaline media, for example, 50% NaOH.

A typical alumina is distributed by Remet Chemical Corp., Chadwicks, N.Y., under the trademark DISPERAL (formerly DISPURAL) and manufactured by Condea Chemie, Brunsbuettel, West Germany. DISPERAL is an aluminum oxide monohydrate which commonly forms stable colloidal aqueous dispersions. Alumina products of this type commonly exist as dry powders which can form thixotropic gels, bind silica and other ceramic substrates, while possessing a positive charge and being substantive to a variety of surfaces.

DISPERAL has a typical chemical composition of 90% alpha aluminum oxide monohydrate (Boehmite) 9% water, 0.5% carbon (as primary alcohol), 0.008% silicon dioxide, 0.005% ferric oxide, 0.004% sodium silicate, and 0.05% sulfur. It has a surface area (BET) of about 320 $m^2/gm$, an undispersed average particle size (as determined by sieving) of 15% (greater than 45 microns) and 85% (less than 45 microns), an average particle size, in dispersion, of 0.0048 microns as determined by X-ray diffraction, and a bulk density of 45 pounds per cubic foot (loose bulk) and 50 pounds per cubic foot (packed bulk). Yet another alumina suitable for use within the present invention, although not as preferred, is manufactured by Vista Chemical Company, Ponca City, Okla. under the trademark CATAPAL SB alumina. CATAPAL SB has a typical chemical composition of 74.2% aluminum oxide (Boehmite), 25.8% water, 0.36% carbon, 0.008% silicon dioxide, 0.005% ferric oxide, 0.004% sodium oxide and less than 0.01% sulfur. It has a surface area (BET) of 280 $m^2/gm$, average particle size (as determined by sieving) of 38% (less than 45 microns) and 19% (greater than 90 microns).

These colloidal alumina thickeners, used in dispersed form in the invention, generally have exceedingly small average particle size in dispersion (i.e., generally less than one micron). In point of fact, the average particle size diameter of these thickeners when dispersed is likely to be around 0.0048 micron. Thus, a preferred average particle size range in dispersion is preferably less than one micron, more preferably less than about 0.5 micron and most preferably less than 0.1 micron. Due to their small particle size, little or substantially no abrasive action is provided by these types of thickeners even though they are chemically insoluble, inorganic particles. Additionally, these colloidal aluminas are chemically quite different from aluminum oxide abrasives, such as corundum. Colloidal aluminas are produced from synthetic Boehmite. In general, they are synthesized by hydrolyzing aluminum alcoholates, with the resulting reaction products being hydrated aluminum oxide (colloidal alumina) and three fatty alcohols. The reaction equation is set forth below:

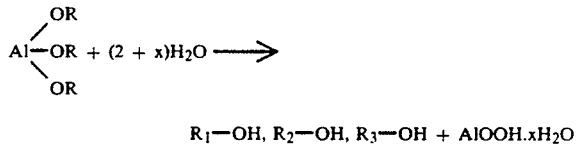

(From Condea Chemie, "PURAL ® PURALOX ® DISPERAL ® High Purity Aluminas" Brochure (1984), the contents of which are herein incorporated by reference.).

These hydrated aluminum oxides are called synthetic Boehmites merely because their crystalline structure appears similar to that of naturally occurring Boehmite. Boehmite, which is the actual mineral, has a Mohs hardness of about 3. It may thus be expected that the synthetic Boehmite would not have a hardness greater than the naturally occurring Boehmite. Corundum, on the other hand, appears to have a Mohs hardness of at least 8 and perhaps higher. Thus any abrasive action provided by colloidal aluminum oxides may be severely mitigated due to their relative softness. An important aspect of the hydrated aluminas used herein is that they should be chemically insoluble, i.e., should not dissolve in acidic, basic or neutral media in order to have effective thickening as well as stability properties. However, colloidal Boehmite aluminas will dissolve in highly basic media, e.g., 50% NaOH.

A further important point is that these colloidal alumina thickeners, in order to be useful as thickeners in the cleansers of this invention, must be initially dispersed in aqueous dispersion by means of strong acids. Preferable acids used to disperse these colloidal aluminas include, but are not limited to, acetic, nitric and hydrochloric acids. Sulfuric acid is not preferred. Generally, a 1–50%, more preferably 5–40%, and most preferably 10–35% dispersion is made up, although in some instances, percentages of colloidal alumina are calculated for 100% (i.e., as if non-dispersed) active content. In practice, the colloidal alumina may be added to water sufficient to make up the desired percent dispersion and then the acid may be added thereto. Or, the acid may be first added to the water and then the colloidal alumina is dispersed in the dilute acid solution. In either case, a substantial amount of shearing (i.e., mixing in a mixing vat) is required to obtain the proper rheology.

Usually, a relatively small amount of concentrated acid is added. For instance, for a 25 wt.% dispersion material, 25% alumina monohydrate is combined with 1.75% concentrated (12M) hydrochloric acid and then dispersed in 73.75% water. The colloidal alumina thickener is generally present in the cleanser in the range of about 1 to 15% by weight, more preferably about 1 to 10% and most preferably about 1 to 6%.

ELECTROLYTES/BUFFERS

The electrolyte/buffer of the present invention must be carefully selected in combination with the surfactant or surfactants and the colloidal alumina thickener in order to produce the plastic rheology and smooth flowing consistency desired for the composition of the present invention. In broad terms, electrolytes/buffers employed within the present invention are generally the alkali metal salts of various inorganic acids, including the alkali metal salts of phosphates, polyphosphates, pyrophosphates, triphosphates, tetrapyrophosphates, silicates, metasilicates, polysilicates, carbonates, hydroxides, and mixtures of the above. Certain divalent salts, for example, alkaline earth salts of phosphates, carbonates, hydroxides, etc., can function singly as buffers. If such compounds were used, they would be combined with at least one of the previous electrolytes/buffers to provide the appropriate pH adjustment. It may also be desirable to use as a buffer such materials as aluminosilicates (zeolites), borates, aluminates and bleach-stable organic materials such as gluconates, succinates, maleates, and their alkali metal salts. These electrolytes/buffers function to maintain the pH range of the inventive cleanser compounds preferably above 7.0, more preferably above 8.0 or 9.0 and most preferably at between about 10.0 and 14.0. The amount of electrolyte/buffer employed within the composition of the present invention can vary from about 1.0% to 25.0%.

As noted above, a preferred embodiment of the present invention contemplates a cleanser composition which is environmentally acceptable in that it is formed from non-phosphate materials. In such a cleanser, the electrolyte/buffer may again be selected in accordance with the same critera set forth above while excluding the phosphates, polyphosphates, pyrophosphates, triphosphates, tetrapyrophosphates, etc. from the list of suitable materials.

More preferably, in an environmentally acceptable cleanser composition, the electrolyte/buffer is selected as a silicate based material, including for example silicates, metasilicates, polysilicates and other variations as described above. The use of silicates is preferred within the present invention in order to form an environmentally acceptable product and also to further enhance cleaning ability of the composition.

In accordance with the criteria set forth above, the electrolyte/buffer of the present invention is preferably a silicate formed by a combination of sodium oxide and silicon dioxide. The present invention preferably contemplates an electrolyte/buffer comprising sodium silicate having a weight ratio of silicon dioxide to sodium oxide of about 3.75/1 to 1.00/1. More preferably, the present invention contemplates an electrolyte/buffer in the form of sodium silicate having a weight ratio of silicon dioxide to sodium oxide of about 2.00/1.

A silicate as described above is available, for example, for the PQ Corporation, Philadelphia, Pa.

SURFACTANT SYSTEM

As was described above and as will be made more apparent in the following examples, the present invention contemplates the essential combination of a fatty acid anionic surfactant with colloidal alumina thickener in a cleanser composition, particularly in the presence of a non-phosphate electrolyte/buffer such as a silicate based material.

Upon the addition of a fatty acid anionic surfactant, that is, a neutralized fatty acid or soap, to such a combination, there was found to be a dramatic change in the "flow rheology" or flow characteristics. More particularly, while the combination of a colloidal alumina thickener with an electrolyte/buffer such as a silicate was found to produce a generally thixotropic consistency, the addition of soap to this combination was found to produce a very unexpected effect in achieving a very plastic rheology and a smooth or creamy flowable consistency in the cleanser even after substantial periods of storage.

Although a soap has been found to be particularly valuable in the present invention for the reason set forth above, soap is also desirable in hard surface cleansers containing a bleach because of the bleach or hypochlorite stability of the soap.

The soap employed according to the present invention is a soluble or dispersible material within the context of the present invention, unlike the prior art "soap filaments", which are obviously insoluble while serving as a thickening agent for cleansers. Either a saturated or unsaturated soap may be employed in combination with the colloidal alumina thickener to achieve the unexpected consistency referred to above. In addition, the soap may be either straight or branched chain fatty acids. Since the general properties of the soap are important in the present invention, it is possible that many other types of soaps, including for example, dicarboxylic acid and ethoxycarboxylic acid, are satisfactory. However, the soap is preferably selected as a saturated product when employed in cleansers containing a bleach in order to maintain bleach stability in the composition. Also, the soap is preferably monovalent in order to be sufficiently soluble for use in the present invention.

As noted above, the use of a soap in combination with a colloidal alumina thickener has been found to provide a very smooth flowable consistency or plastic rheology in a cleanser composition containing abrasives. However, an additional surfactant component is also desirable to improve cleaning and rinsing as well as to substantially eliminate syneresis within the cleanser composition. Accordingly, an additional surfactant is presently employed in combination with the soap or fatty acid anionic surfactant, that additional surfactant being selected for example from anionic, nonionic, amphoteric, zwitterionic surfactants and mixtures thereof. Where the cleanser also includes a bleach, the additional surfactant is also selected for purposes of bleach stability.

A preferred additional surfactant employed with the fatty acid anionic surfactant or soap is preferably a nonionic surfactant selected from the group consisting essentially of amine oxides. An even more preferred additional surfactant employable together with the fatty acid anionic surfactant or soap of the present invention is a mixed surfactant of the type disclosed in the copending reference noted above. Such a mixed surfactant combination is described in greater detail below and preferably comprises an anionic surfactant such as a secondary alkane sulfonate and a nonionic surfactant such as an amine oxide. This combination also exhibits bleach stability when used in a cleanser containing a bleach component.

Additional information concerning both the fatty acid anionic surfactant and the additional surfactant component of the present invention are set forth in greater detail below.

FATTY ACID ANIONIC SURFACTANT

Both the type and amount of the soap to be employed within the present invention are of essential importance. Initially, as noted above, the soap must be of a univalent type which is generally soluble or dispersible in order to function in accordance with the present invention. As also noted above, the soap may be either saturated or unsaturated to produce the unexpected flow characteristics noted above in combination with colloidal alumina thickener. However, a saturated soap is employed in cleansers containing a bleach for purposes of bleach stability. Also, soaps containing either straight or branched chain fatty acids may be employed within the invention.

As for the essential characteristics of the soap in addition to those noted above, the soap is generally limited to a molecular weight range characterized by having from about six to twenty carbon groups, either in a straight or branched chain configuration. More preferably, the soap is of a type having from about eight to eighteen carbon groups, even more preferably from about ten to fourteen carbon groups while a particularly preferred fatty acid anionic surfactant employed in the composition of the present invention is demonstrated by the following examples contains twelve carbon groups.

As for the amount of soap employed in a cleanser according to the present invention, it is necessary to also consider the amount of colloidal alumina thickener employed in the composition. Generally, the advantageous flow characteristics of the present invention are realized with a maximum amount of about 2.5 to 5% by weight based on the entire weight of the composition. At the same time, no more than about 3% by weight of soap appears to be useful in a preferred embodiment of the present invention. More specific examples as to the amount of soap and colloidal alumina thickener employed in the present invention is demonstrated by the following examples. However, it is noted that reasonable characteristics of flow have been demonstrated with a cleanser composition having about 2% colloidal alumina thickener and about 0.5 to about 1.5% by weight of soap. Such compositions demonstrated limited syneresis which as will be described in greater detail below, can be substantially entirely eliminated by employing an additional surfactant component.

Suitable fatty acid anionic surfactants or soaps according to the present invention may be selected from the class consisting of potassium laurate, sodium laurate, sodium stearate, potassium stearate, sodium oleate, etc. Similar soaps containing ammonium ion as a cation may also be used particularly if the cleanser does not contain a bleach. Suitable soaps for use within the present invention are disclosed in Chemical Publishing Co., Inc., Encyclopedia Of Surface-Active Agents, Vol. I (1952), page 39 etc., Kirk-Othmer, Encyclopedia of Chemical Technology 3d, Vol. 21 pp. 162–181 re "Soaps" and Vol. 22, re "Surfactants". Accordingly, those references are incorporated herein as though set out in full.

The manner in which the fatty acid anionic surfactant or soap functions in combination with the colloidal alumina thickener according to the present invention is not fully understood. It is believed that the soap may be useful for reasons described below. However, the present invention is not to be limited by the following theory.

Initially, it is not merely the anionic form of the soap that makes it useful within the present invention since other anionic surfactants have been tested without achieving the same advantages. The soaps herein appear, overall, to be more hydrophobic in nature than other anionic surfactants. While not being entirely understood, this more hydrophobic nature of the soaps surprisingly appear to help maintain uniform dispersion of the solids portion (abrasives and colloidal alumina) in the aqueous phase. Thus, this characteristics of the soap unexpectedly and advantageously promotes the smooth, plastic rheology of the invention.

In further supposition, it is also noted that the soap has been particularly effective in combination with colloidal alumina thickener where the cleanser also contains a silicate based material as an electrolyte/-buffer. In this regard, it is theorized that the silicate and alumina may function to form a network, possibly through the formation of bridging oxygens, in order to produce a very thixotropic composition similar to compositions employing clay as a thickening agent.

It is believed that soap, having a carboxyl group which is hydrophilic in combination with a hydrophobic alkyl chain functions to break up the network formed between the silicate and alumina in order to soften the composition and result in the smooth flowable consistency realized by the present invention.

ADDITIONAL SURFACTANT COMPONENT

As noted above, the fatty acid anionic surfactant or soap may be employed by itself in combination with colloidal alumina thickener in order to achieve smooth flowing characteristics according to the present invention. However, certain properties of a cleanser containing colloidal alumina thickener or soap are further enhanced by also employing an additional surfactant component of the type summarized above.

As was also mentioned above, the additional surfactant component suitable for use in the present invention can be selected from the group consisting of anionic, bleach-stable nonionic, amphoteric, zwitterionic surfactants and mixtures thereof. It is especially preferred to use a combination of anionics and bleach-stable nonionics, particularly in a cleanser composition which also contains a bleach.

Anionic surfactants employable as the additional surfactant component of the present invention can be selected from the group consisting of alkali metal alkyl sulfates, secondary alkane sulfonates, linear alkyl benzene sulfonates, and mixtures thereof. These anionic surfactants will preferably have alkyl chain groups averaging about 8 to 20 carbon atoms or carbon groups.

In practice, other anionic surfactants which do not degrade chemically when in contact with a hypohalite, such as hypochlorite, should also work. An example of a particularly preferred secondary alkane sulfonate is HOSTAPUR SAS, manufactured by Farbwerke Hoechst A.G., Frankfurt, West Germany. An example of typical alkali metal salts of alkyl benzene sulfonic acids are those sodium alkyl benzene sulfonates manufactured by Pilot Chemical Company sold under the trademark CALSOFT. An example of a typical alkali metal alkyl sulfate is CONCO SULFATE WR, sold by Continental Chemical Company and having an alkyl group of about 12 carbon atoms.

Examples of preferred nonionic bleach-stable surfactants are amine oxides, especially trialkyl amine oxides. A representative structure is set forth below in FIG. I.

FIG. I

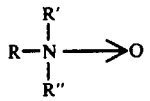

In FIG. I above, R′ and R″ can be alkyl chains of 1 to 3 carbon atoms, most preferably $CH_3$—, and R is an alkyl chain of about 10 to 20 carbon atoms. When R′ and R″ are both $CH_3$— and R is an alkyl chain averaging about 12 carbon atoms, the structure for dimethyldodecylamine oxide, a particularly preferred amine oxide, is obtained. Representative examples of this particular type of bleach-stable nonionic surfactants include the dimethyldodecylamine oxides sold under the trademark AMMONYX LO by Onyx Chemical Division of Millmaster Onyx Group. Yet other preferred amine oxides are those sold under the trademark BARLOX, by Lonza, Inc. Still others include the CONCO XA series, sold by Vista Chemical Company, the AROMAX series sold by Armak Industrial Chemical Company, and the SCHERCAMOX series, sold by Scher Chemicals, Inc. These amine oxides preferably have main alkyl chain groups averaging about 10 to 20 carbon atoms. Other types of suitable surfactants include amphoteric surfactants, exemplary of which are betaines, imidazolines and certain quaternary phosphonium and tertiary sulfonium compounds. Particularly preferred are betaines such as N-carboxymethyl-N-dimethyl-N-(9-octadecenyl)ammonium hydroxide and N-carboxymethyl-N cocoalkyl-N-dimethyl ammonium hydroxide, the latter of which is sold under the trademark LONZAINE by Lonza Corporation. Other acceptable surfactants are the zwitterionic surfactants exemplified in U.S. Pat. No. 4,005,029, issued to Jones, columns 11–15 of which are incorporated herein by reference.

As mentioned previously, it is particularly preferred to combined at least two of these surfactants, most preferably the anionics and the bleach-stable nonionics. Combinations of these types of surfactants appear to be particularly favorable for maintaining hypochlorite half-life stability at elevated temperatures for long periods of time. Additionally, when these particular combinations of surfactants are combined with the alumina thickener, the formulations thus produced are practically free from syneresis.

The other surfactant component described above together with the soap are generally present in the cleanser in a range of about 0.1 to 15% by weight, more preferably about 0.1 to 8% and most preferably about 0.1 to 5%.

BLEACH

A source of bleach is selected from various halogen bleaches. For the purposes of the present invention, halogen bleaches are particularly favored. As examples thereof, the bleach can be selected from the group consisting essentially of the alkali metal and alkaline earth salts of hypohalite, hypohalite addition products, haloamines, haloimines, haloimides and haloamides. These also produce hypohalous bleaching species in situ with hypochlorites being a preferred form of bleach. Representative hypochlorite producing compounds include sodium, potassium, lithium and calcium hypochlorite, chlorinated trisodium phosphate dodecahydrate, potassium and sodium dichloroisocyanurate, trichloroisocyanuric acid, dichlorodimethyl hydantoin, chlorobromo dimethylhydantoin, N-chlorosulfamide, and chloramine.

As noted above, a preferred bleach employed in the present invention is sodium hypochlorite having the chemical formula NaOCl, in an amount ranging from about 0.10% to about 5%, more preferably about 0.25% to 4% and most preferably 0.5% to 2.0%. The purpose for the bleach is evident in forming an oxidizing cleaning agent which is very effective against oxidizable stains such as organic stains.

A principal problem with the use of bleach in such compositions is its tendency to be unstable or to cause instability of other components, particularly certain surfactants if they are present in substantial amounts. In any event, because of the use of colloidal alumina as a thickener in the present invention together with a fatty acid anionic surfactant and only limited amounts of additional surfactant components, the bleach stability of the composition of the present invention (expressed in half-life stability) is surprisingly good resulting in a product capable of maintaining excellent flow characteristics and bleach strength even after considerable periods of shelf life.

ABRASIVES

Abrasives are used in the invention to promote cleaning action by providing a scouring action when the cleansers of the invention are used on hard surfaces. Preferred abrasives include silica sand, but other hard abrasives such as a perlite, which is an expanded silica, and various other insoluble particulate abrasives can be used, such as quartz, pumice, calcium carbonate, feldspar, talc, tripoly and calcium phosphate. Abrasives can be present in amounts ranging from about 5 to 70, and more preferably between 20 and 50 percent, by weight of the compositions of this invention.

In contrast with the colloidal alumina thickener employed within the present invention, it is to be noted that the abrasives of the type set forth above are present in the cleanser composition in substantially larger average particle sizes, for example at least about one micron and preferably to as high as 400 to 500 microns for example.

Abrasives are generally sold as grades based on U.S. Mesh Sieve sizes. The U.S. Sieve sizes are inversely related to measurements in microns, wherein 80 mesh sieves correspond to about 180 microns, and 325 mesh sieves correspond to about 45 microns. For one preferred grade of abrasives used in this invention, namely grade 140 mesh, more than about 20% of the particles will be retained on a U.S. 325 mesh sieve (i.e., is greater than about 45 microns). Particle hardness of the abrasives can range from Mohs hardness of about 2–10, more preferably 3–8. Abrasives are generally insoluble inorganic materials (although there are some organic abrasives, to wit, melamine granules, ureo formaldehyde, corn cobs, rice hulls, etc.).

Some thickeners are also insoluble inorganic materials, for instance, the colloidal aluminum oxide thickeners of this invention. However, the colloidal alumina thickeners of this invention distinguish from aluminum oxide abrasives in many aspects. Colloidal alumina thickeners appear to have an average particle size of much smaller than one micron. Aluminum oxide abrasives on the other hand will be much larger (can range up to 500 microns) and even in aqueous dispersion, will not thicken the cleansers of this invention. As mentioned above, the colloidal alumina thickeners must be initially dispersed in acidic media to provide thickening. Further, without the colloidal thickeners of this invention, abrasives, even aluminum oxide abrasives, cannot be stably suspended.

In addition to the components for the cleaning composition of the present invention as set forth above, further desirable adjuncts may include bleach-stable dyes (for example, anthraquinone dyes), pigments (for example, ultramarine blue), colorants and fragrances in relatively low amounts, for example, about 0.001% to 5.0% by weight of the cleanser composition.

A composition according to the present invention is preferably characterized by a minimum yield value or a yield value with the composition substantially "at rest" in the range of 5 to 80 dynes/cm$^2$, more preferably in the range of 14 to 30 and most preferably in the range of 18 to 25. The minimum yield value is discussed in connection with the single figure of the drawings and is also discussed in greater detail below with respect to various of the examples. Theoretically, there is no upper limit for yield value since any value above about 5 will exhibit desired suspension. However, an upper limit of 80 is provided as a practical matter to insure that the composition remains flowable.

The invention is further demonstrated by the examples and results set forth below.

TABLE I below sets forth compositions for Examples #1, #2 and #3 while listing the amount as a weight percentage of the entire composition. It is to be noted that certain components of the compositions are present as dispersions or solutions. Accordingly, the active amount of the listed component will be less than what is shown in the tabular presentation for the examples.

In TABLE I as in the following examples, components in the examples are generally in accordance with components described in the specification above. Footnotes have been added to TABLE I to further identify certain of the components. When those components appear in additional examples, reference may be made to the same footnotes for further explanation. Certain components not listed in TABLE I appear in following examples and are also similarly identified by footnotes.

TABLE I

| Component | EXAMPLE #1 (wt. %) | #2 (wt. %) | #3 (wt. %) |
|---|---|---|---|
| DISPERAL (25% Dispersion)[1] | 11.0 | 11.0 | 11.0 |
| $H_2O$ | 25.5 | 25.5 | 41.5 |
| NaOH (50% Solution) | 1.25 | 1.25 | 1.25 |
| NEOFAT 12-43[2] | 1.0 | — | 1.0 |
| NEOFAT 90-04[3] | — | 1.0 | — |
| Silica Sand (140 mesh) | 30.0 | 30.0 | 30.0 |
| $TiO_2$[4] | 0.75 | 0.75 | 0.75 |
| NaOCl Bleach (5.4% Solution) | 16.0 | 16.0 | — |
| AMMONYX LO[5] | 1.9 | 1.9 | 1.9 |
| HOSTAPUR[6] | 2.6 | 2.6 | 2.6 |
| Sodium Silicate Solution D | 10.0 | 10.0 | 10.0 |
| Fragrance[7] | 0.04 | 0.04 | 0.04 |
| | about 100.00 | about 100.00 | about 100.00 |

[1]Alumina ($Al_2O_3 \cdot H_2O$), manufactured by Condea Chemie, Brunsbuettel, West Germany
[2]Lauric acid, manufactured by Armak Division of Akzona, Inc., Chicago, Illinois
[3]Oleic acid, manufactured by Armak Division of Akzona, Inc., Chicago, Illinois
[4]Titanium dioxide as a pigment.
[5]Amine oxide surfactant (30% solution) manufactured by Onyx Chemical Division of Millmaster Onyx Corporation.
[6]Secondary alkyl sulfonate surfactant (60% surfactant), manufactured by Farbwerke Hoechst A.G., Frankfurt, West Germany
[7]44.1% solution of sodium oxide and silicon dioxide in water as an electrolyte/buffer, manufactured by Philadelphia Quartz Corp., Valley Forge, PA.

Examples #1 and #2, as set forth in TABLE I, each exemplify a composition according to the present invention including (a) a colloidal alumina thickener; (b) an electrolyte/buffer; (c) a surfactant system including a fatty acid anionic surfactant, that is, a soap, and an additional mixed surfactant component; (d) a halogen bleach; and (e) a particulate abrasive, specifically silica sand. Example #3 is a similar composition but without halogen bleach.

The composition represented by Example #1 exhibited excellent suspension of the abrasive particles and excellent bleach stability as well in accordance with the invention. At the same time, the compositions of Examples #1, #2 and #3 also demonstrated a substantial absence of syneresis.

Examples #1, #2 and #3 further demonstrated variations in a formulation according to the present invention in that Examples #1 and #3 contain a saturated lauric acid soap while Example #2 contains an unsaturated oleic acid soap. In addition, Example #3 demonstrates the possibility of forming the composition of the invention without a bleach.

EXAMPLE #4

| Component | (Wt. %) |
|---|---|
| DISPERAL (25% dispersion)[1] | 11.0 |
| $H_2O$ | 25.5 |
| NaOH (50% solution) | 1.25 |
| NaOCl Bleach (5.25% solution) | 16.00 |
| Abrasive (140 mesh silica sand) | 30.00 |
| $TiO_2$[4] | 0.75 |
| AMMONYX LO[5] | 1.91 |
| HOSTAPUR[6] | 2.60 |
| NEOFAT 12-43[2] | 1.00 |
| Sodium Silicate Solution D[7] | 10.00 |
| Fragrance | 0.04 |
| | about 100.00 |

The composition of Example #4 is a preferred formulation according to the present invention and includes generally the same components summarized above in connection with Examples #1–#3 of TABLE I.

The composition of Example #4 is similar to the compositions of Examples #1 and #3 in that it contains a saturated lauric acid soap.

The superior suspension capability of the composition of Example #4 as well as its plastic rheology or pourable nature is demonstrated by the rheogram shown in the single drawing of the application.

Referring also to FIG. 1, the single illustrated rheogram demonstrates a number of superior characteristics in the composition of Example #4. In explanation of the rheogram, it was made with a Haake Rotoviscometer using an MVIII spindle having a conversion factor of 0.496. Thus, for a shear stress value of about 45 as represented by the peak in the initial portion of the curve in the rheogram of the FIG. 1, the minimum yield value for the composition would be (45) (0.496) equals 22.32 or about 22.5 dynes/square centimeters ($cm^2$).

As generally indicated in FIG. 1, shear rate is calculated for any point on the curve by extrapolating to the X axis to determine the corresponding rotor speed. The rotor speed can be converted to shear rate by multiplying the rotor speed times a conversion factor dependent on the particular spindle used. For the MVIII spindle used in preparation of the rheogram of FIG. 1, this conversion factor is 0.44. Multiplication of this factor times the rotor speed results in determination of the shear rate ($sec^{-1}$). However, as will be apparent from the description herein, the calculation of shear rate is not of particular importance in connection with the present invention except to the extent that it determines the general slope of the rheogram or curve as discussed in greater detail below.

Referring to FIG. 1, it is noted that the two sides of the curve in the rheogram are closely proximate to each other. Because of the close proximity of the two sides of the curve or, in other words, because of the minimum area enclosed within the curve in combination with the inclined slope of the curve, the composition of Example #4 demonstrates a very desirable plastic rheology providing uniform flow characteristics.

The slope of the rheogram or curve is also significant in connection with the present invention. As noted above, since the two sides of the curve are closely proximate to each other, they also necessarily have approximately the same slope. Such a slope of substantial incline, as shown in FIG. 1, demonstrates that, as the shear rate increases, shear stress increases in a generally proportional manner. Such a characteristic indicates that a desirable plastic rheology has been achieved in the composition since flowability of the composition remains generally consistent regardless of the amount of force applied to the composition or liquid. Thus, a liquid composition with plastic rheology will flow uniformly regardless of whether it has been at rest for a substantial time or agitated, for example, by being shaken or squeezed in its container.

Regardless of how much shear is applied to the Example #4 composition, as demonstrated by the rheogram in FIG. 1, it exhibits very consistent flowability. Thus, in a cleanser container, the composition exhibits very uniform flowability, for example, on being squirted out of a nozzle of the container regardless of whether the container is first shaken or agitated.

Secondly, the rheogram of FIG. 1 demonstrates the ability of the composition of Example #4 to suspend solids, particularly the abrasive material. This characteristics of the composition is better indicated by yield value rather than viscosity. In a rheogram as shown in FIG. 1, the yield value may be calculated as described above.

The minimum yield value of the composition or in other words, the yield value with the composition substantially "at rest", is particularly important to assure solids suspending capabilities. As noted above, a cleanser composition according to the present invention generally has a yield value in the range of about 5 to 80, more particularly from about 14 to 30 and most preferably from about 18 to 25. Note that the curve of FIG. 1 and the initial yield point of about 45 indicates a minimum yield value of about 22.5 dynes/$cm^2$ taking into consideration the spindle characteristics described above. Such a composition is desirable in order to assure the suspension capabilities for solids while also making the composition flowable and suitable to be poured from a container to facilitate use of the cleanser.

Figure 2:
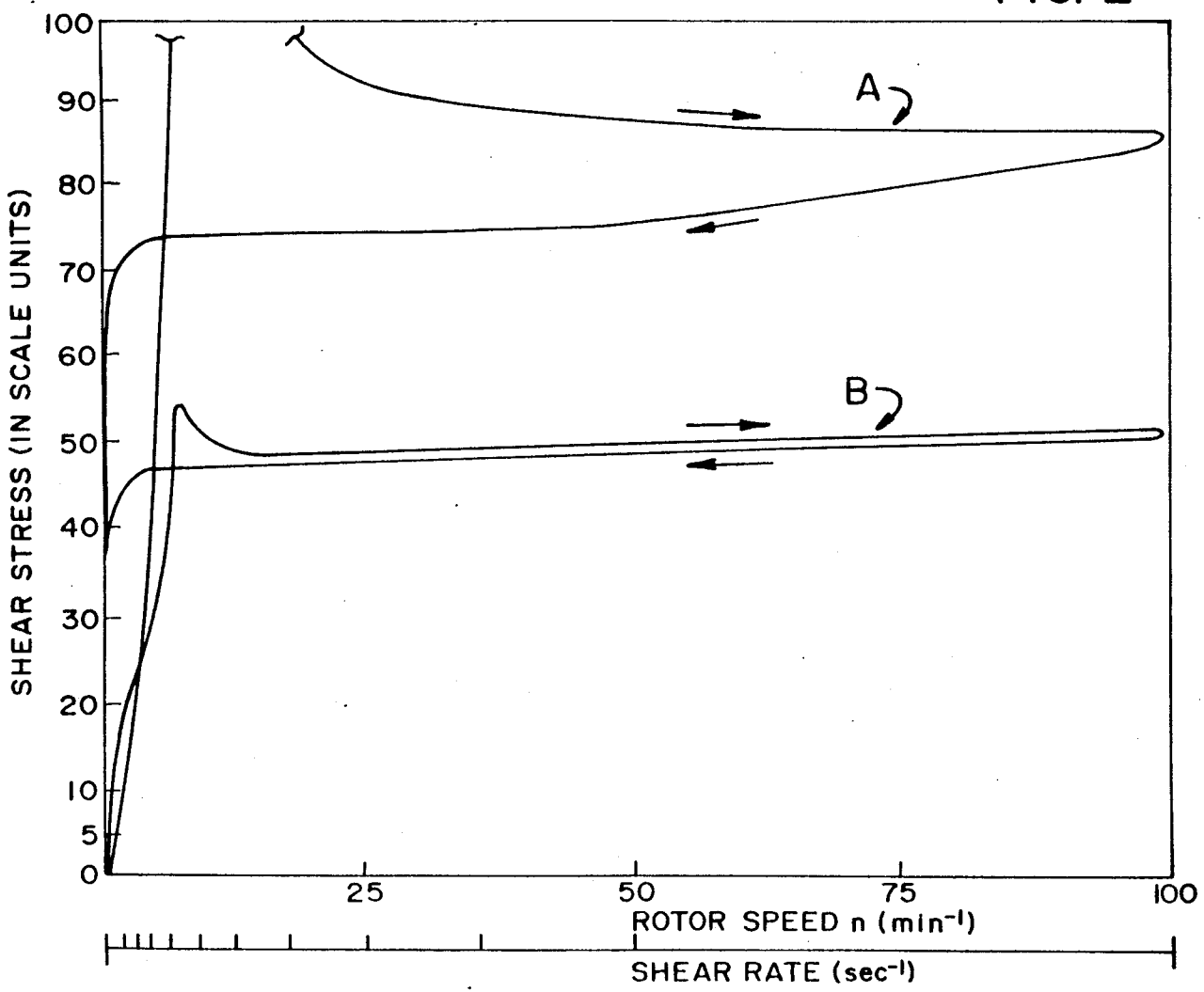
FIG. 2 includes two rheograms illustrating different conditions of a single prior art composition described in greater detail below.

FIG. 2 of the drawings demonstrates the non-plastic rheology of a prior art commercial cleanser, COMET Liquid Cleanser from Proctor & Gamble Company, Cincinnati, Ohio. The formula of COMET Liquid Cleanser generally appears to follow the formulations set forth in Hartman U.S. Pat. No. 4,005,027, and containing hypochlorite bleach, clay thickeners, abrasives and certain surfactants.

FIG. 2 includes two separate rheograms, an upper rheogram or curve indicated at A and a lower rheogram or curve indicated at B. The upper rheogram or curve A demonstrates the rheology of the thickened liquid cleanser identified above after it has been "at rest" or undisturbed for a substantial period of time. The upper rheogram or curve A was then made using the same technique and spindle as described above in connection with FIG. 1. Thus, using a Haake MVIII spindle, the above noted cleanser in an initially undisturbed condition resulted in an initial yield value which was off scale (as indicated by the discontinuity in the initial portion of the upper curve or rheogram A). This characteristic of the curve indicated that the cleanser, at rest, thickened or hardened to an undesirable degree requiring application of consideration force or shear in order to develop a flow condition.

It may also be noted from FIG. 2 that, in the initial portion of the upper rheogram or curve A, as the shear rate increased, the product demonstrated a dramatic degree of thinning as shown by the declining slope of the curve. In the return portion of the upper rheogram or curve A, as shear rate decreased, the product continued its thinning tendency. Thus, the product represented by the upper rheogram or curve A clearly demonstrated a thixotropic nature.

In the overall context of the present invention, this type of rheology is considered undesirable since it indicates a tendency for the product to harden or set up during extended storage of the product. Thus, such a product is generally not capable of exhibiting the desirable uniform flow characteristics discussed at length elsewhere herein.

The lower rheogram or curve B demonstrates the rheology of the same product or composition discussed above in connection with the upper rheogram or curve A. However, prior to making the lower rheogram or curve B, the cleanser was lightly shaken in order to partially break up the hardened or gelled consistency of the cleanser as described above. However, as illustrated in the lower rheogram or curve B, as the shear rate increased, the shear stress remained generally constant, indicating a continued thinning of the product in response to the application of force from the rheogram spindle. The rheology demonstrated for a product by this type of rheogram or curve is denoted as being "false bodied". Such a condition is similarly undesirable within the context of the present invention since it prevents the achieving of generally consistent, smooth flowability regardless of shear conditions.

TABLE II below sets forth compositions for Examples #5, #6 and #7 according to the present invention. Here again, Examples #5, #6 and #7 also include components as were generally summarized above in connection with Examples #1–#3.

TABLE II

| Component | EXAMPLE #5 (wt. %) | #6 (wt. %) | #7 (wt. %) |
|---|---|---|---|
| DISPERAL (25% dispersion)[1] | 2.00 | 17.00 | 14.00 |
| $H_2O$ | 31.73 | 20.61 | 20.73 |
| Abrasive (140 mesh silica sand) | 30.00 | 30.00 | 30.00 |
| $TiO_2$[4] | 0.75 | 0.75 | 0.75 |
| NaOCl Bleach (5.4% Solution) | 16.00 | 16.00 | 16.00 |
| NaOH (50% Solution) | 2.50 | 0.625 | 2.00 |
| NEOFAT 12-43[2] | 2.50 | 0.50 | 2.00 |
| AMMONYX LO[5] | 1.93 | 1.93 | 1.93 |
| HOSTAPUR[6] | 2.55 | 2.55 | 2.55 |
| Sodium Silicate Solution D[7] | 10.00 | 10.00 | 10.00 |
| Fragrance | 0.04 | 0.04 | 0.04 |
| | about 100.00 | about 100.00 | about 100.00 |

Examples #5–#7 also exhibited the superior characteristics of a composition according to the present invention. Generally, as was also noted above, these examples included components as summarized in connection with Examples #1–#3 while further demonstrating a range of alumina thickeners with varying amounts of soap in cleanser compositions according to the present invention which also contain abrasive, bleach and a mixed surfactant system. In particular, note that Example #5 includes a low amount of alumina thickener and a relatively high amount of soap (NEOFAT 12–43). Example #6 demonstrated a cleanser composition with a high percentage of alumina thickener and a relatively low percentage of the same soap component. Finally, Example #7 illustrates a cleanser composition with a high intermediate amount of alumina thickener and a relatively high intermediate amount of the same soap component as well.

TABLE III sets forth compositions for Examples #8 and #9. The components of those two examples are also generally similar to the components of Examples #1–#3 as summarized above.

TABLE III

| Component | EXAMPLE #8 (wt. %) | #9 (wt. %) |
|---|---|---|
| DISPERAL (25% Dispersion)[1] | 11.0 | 11.0 |
| $H_2O$ | 25.48 | 25.48 |
| NaOH (50% Solution) | 1.25 | 1.25 |
| NaOCl Bleach (5.4% Solution) | 16.00 | 16.00 |
| Abrasive (140 mesh silica sand) | 30.00 | 30.00 |
| $TiO_2$[4] | 0.75 | 0.75 |
| AMMONYX LO[5] | 1.93 | 1.93 |
| HOSTAPUR[6] | 2.55 | 2.55 |
| EMERY 627[8] | 1.00 | — |
| NEOFAT 90-04[3] | — | 1.00 |
| Sodium Silicate Solution D[7] | 10.00 | 10.00 |
| Fragrance | 0.04 | 0.04 |
| | about 100.00 | about 100.00 |

[8]Coco fatty acid soap, manufactured by Emery Chemicals, Cincinnati, Ohio.

Examples #8 and #9 in TABLE III demonstrate the ability to use either a saturated or unsaturated soap in the composition of the present invention. Note that the other components of Examples #8 and #9 are similar while Example #8 contains a saturated soap and Example #9 contains an unsaturated soap. Otherwise, the compositions of Examples #8 and #9 also generally exhibited the favorable characteristics of a composition according to the present invention as discussed above.

TABLE IV below sets forth compositions for Examples #10 and #11 which also generally comply with the summary set forth above in connection with Examples #1–#3 according to the present invention.

TABLE IV

| Component | EXAMPLE #10 (wt. %) | #11 (wt. %) |
|---|---|---|
| DISPERAL (25% Dispersion)[1] | 16.00 | 10.00 |
| $H_2O$ | 19.48 | 6.48 |
| Abrasive (140 mesh silica sand) | 10.00 | 60.00 |
| $TiO_2$[4] | 0.75 | 0.75 |
| NaOCl Bleach (5.4% Solution) | 37.00 | 8.00 |
| NaOH (50% Solution) | 1.25 | 1.25 |
| NEOFAT 12-43[2] | 1.00 | 1.00 |
| AMMONYX LO[5] | 1.93 | 1.93 |
| HOSTAPUR[6] | 2.55 | 2.55 |
| Sodium Silicate Solution D[7] | 10.00 | 8.00 |
| Fragrance | 0.04 | 0.04 |
| | about 100.00 | about 100.00 |

Examples #10 and #11 as set forth above in TABLE IV demonstrate the possibility of forming compositions, according to the present invention, which respectively contain relatively high amounts of bleach and abrasive.

As set forth above, Example #10 contains approximately 37.00% of the bleach solution or about 2.0 wt. % sodium hypochlorite bleach based on 100 parts of the entire composition. In the composition of Example #10, the amount of abrasive is relatively low in order to permit addition of the water of solution accompanying the bleach.

Example #11 sets forth a composition containing about 60.00% by weight of abrasive. At the same time, the amount of bleach is substantially reduced in Example #11 in order to eliminate the water of solution necessarily accompanying the bleach as necessary to achieve the high abrasive level.

Characteristics of the composition of Example #10 are generally similar to those set forth as being desirable for the present invention. The composition of Example #11 is naturally quite thick and gritty while also being very slow in terms of pourability or flow characteristics. However, Example #11 does demonstrate the ability to form the composition of the present invention with such a high percentage of abrasive.

EXAMPLE #12

| Component | (Wt. %) |
|---|---|
| DISPERAL (25% dispersion)[1] | 20.00 |
| $H_2O$ | 21.48 |
| Abrasive (140 mesh silica sand) | 30.00 |
| $TiO_2$[4] | 0.75 |

-continued

| Component | (Wt. %) |
|---|---|
| NaOCl Bleach (5.4% Solution) | 16.00 |
| NaOH (50% Solution) | 1.25 |
| NEOFAT 12-43[2] | 1.00 |
| AMMONYX LO[5] | 1.93 |
| HOSTAPUR[6] | 2.55 |
| Sodium Carbonate ($Na_2CO_3$)[9] | 5.00 |
| Fragrance | 0.04 |
| | about 100.00 |

Example #12 also generally corresponds with the components summarized above in connection with Examples #1-#3. However, Example #12 illustrates a further variation of the invention in that its composition contains a carbonate as an electrolyte/buffer instead of sodium silicate as employed in the preceding examples.

TABLE V below sets forth compositions for Examples #13 and #14 while demonstrating a cleanser composition according to the present invention which comprises (a) a colloidal alumina thickener; (b) an abrasive; (c) an electrolyte/buffer; and (d) a fatty acid anionic surfactant, that is, a soap as the surfactant component.

TABLE V

| | EXAMPLE | |
|---|---|---|
| Component | #13 (wt. %) | #14 (wt. %) |
| DISPERAL (25% Dispersion)[1] | 16.00 | 16.00 |
| $H_2O$ | 40.96 | 40.96 |
| Abrasive (140 mesh silica sand) | 30.00 | 30.00 |
| $TiO_2$[4] | 0.75 | 0.75 |
| NaOH (50% Solution) | 1.25 | 1.25 |
| NEOFAT 90-04[3] | — | 1.00 |
| NEOFAT 12-43[2] | 1.00 | — |
| Sodium Silicate Solution D[7] | 10.00 | 10.00 |
| Fragrance | 0.04 | 0.04 |
| | about 100.00 | about 100.00 |

As noted above, the compositions of Examples #13 and #14 also illustrate generally the same desirable characteristics as the other cleanser compositions of the invention. However, it is to be noted that each of these examples includes alumina thickener as a component together with soap as the only surfactant component. These examples contain neither a nonionic surfactanet nor an anionic surfactant other than the soap itself.

Although exhibiting generally satisfactory characteristics in accordance with the present invention, these examples do illustrate the general desirability of the additional surfactant components, that is the amine oxide and secondary alkyl sulfonate surfactants to provide certain particularly desirable characteristics in the composition. In particular, as noted above, those additional surfactant components are employed in various examples of the present invention to achieve improved dispersibility of the formulation. As was also noted above, the nonionic or amine oxide surfactant is also particularly employed to help prevent or eliminate syneresis or, in other words, to maintain improved phase stability in the composition.

EXAMPLE #15

| Component | (Wt. %) |
|---|---|
| DISPERAL (25% dispersion)[1] | 11.00 |
| $H_2O$ | 41.50 |

-continued

| Component | (Wt. %) |
|---|---|
| NaOH (50% Solution) | 1.25 |
| NaOCl Bleach (5.4% Solution) | — |
| Abrasive (140 mesh silica sand) | 30.00 |
| $TiO_2$[4] | 0.75 |
| AMMONYX LO[5] | 1.91 |
| HOSTAPUR[6] | 2.55 |
| NEOFAT 12-43[2] | 1.00 |
| Sodium Silicate Solution D[7] | 10.00 |
| Fragrance | 0.04 |
| | about 100.00 |

The composition of Example #15 demonstrates the ability of a cleanser formulation within the scope of the present invention to provide very satisfactory characteristics of plastic rheology, flowability and solid suspension ability. To further demonstrate versatility of the invention, the composition of Example #15 was formed without the inclusion of bleach. As the same time, the composition of Example #15 included both soap and an additional mixed surfactant component so that its composition also demonstrated a very desirable absence of syneresis.

EXAMPLE 190 16

| Component | (Wt. %) |
|---|---|
| VAN GEL ES (10% Dispersion)[10] | 31.4 |
| $H_2O$ | 7.5 |
| NaOH (50% Solution) | 0.3 |
| NEOFAT 12-43[2] | 0.25 |
| NaOCl Bleach (5.25% Solution) | 19.05 |
| Sodium Carbonate ($Na_2CO_3$)[9] | 10.00 |
| Abrasive (140 mesh silica sand) | 30.00 |
| HOSTAPUR[6] | 1.50 |
| | about 100.00 |

[10]Smectite clay, manufactured by R. T. Vanderbilt Company, Inc., Norwalk, CT.

The composition of Example #16 illustrates a further variation of the present invention in that it comprises in combination (a) an inorganic colloid; (b) a halogen bleach; (c) a fatty acid anionic surfactant, that is, a soap; and (d) an electrolyte/buffer to promote the environment in which the inorganic colloid and the fatty acid surfactant can associate to provide proper or desired rheology as described above in connection with the present invention.

Example #16 contains a clay as a thickener in place of the colloidal alumina thickener generally employed within the preceding examples. Thus, the composition of Example #16 demonstrates the adaptability of the present invention in that a combination of the clay and a soap provides a composition with similarly improved plastic rheology in accordance with the invention.

As with other Examples herein, sodium hydroxide is employed to adjust the initial pH of the cleanser composition whereas the electrolyte/buffer serves to maintain the general pH of the composition.

In TABLE VI below, Examples #17-#19 illustrate other variations of compositions according to the present invention where clay is employed as a colloidal inorganic thickener in combination with other non-phosphate electrolyte/buffers. In this regard, it is again noted that Example #16 set forth immediately above also employed clay as a colloidal inorganic thickener in combination with sodium carbonate as an electrolyte/-buffer.

TABLE VI

| Component | EXAMPLE #17 (wt. %) | #18 (wt. %) | #19 (wt. %) |
|---|---|---|---|
| VAN GEL ES (10% dispersion)[10] | 27.50 | 27.50 | 27.50 |
| $H_2O$ | 13.98 | 16.65 | 8.98 |
| Abrasive (140 mesh silica sand) | 30.00 | 30.00 | 30.00 |
| $TiO_2$[4] | 0.75 | 0.75 | 0.75 |
| NaOCl Bleach (5.4% Solution) | 16.00 | 16.00 | 16.00 |
| NaOH (50% Solution) | 1.25 | 1.25 | 1.25 |
| NEOFAT 12-43[2] | 1.00 | 1.00 | 1.00 |
| AMMONYX LO[5] | 1.93 | 1.93 | 1.93 |
| HOSTAPUR[6] | 2.55 | 2.55 | 2.55 |
| Sodium Carbonate ($Na_2CO_3$)[9] | 5.00 | — | — |
| Borax ($Na_2B_4O_2.10H_2O$)[11] | — | 2.33 | — |
| Sodium Silicate Solution D[7] | — | — | 10.00 |
| Fragrance | 0.04 | 0.04 | 0.04 |
| | about 100.00 | about 100.00 | about 100.00 |

[11]Hydrated Sodium Borate, manufactured by U.S. Borax & Chemical Company, Inc., Anaheim, CA.

The compositions of Examples #17–#19 in Table VI taken together with Example #16 above demonstrate the ability to form compositions according to the present invention with clay as a colloidal inorganic thickener and different chemical compositions forming electrolyte/buffers for the composition. Note that Examples #17, #18 and #19 respectively include a carbonate, a borax and a silicate as an electrolyte/buffer. Furthermore, it is noted that the alumina employed in various preceding examples similarly serves as an inorganic colloid as well as the clay of these examples. In any event, the compositions of Examples #16–#19 exhibit similarly desirable characteristics of rheology, flow and suspension capabilities as summarized above for the present invention.

The present invention also contemplates methods for forming cleansers including compositions such as those described above and illustrated by the various examples. Generally, such a method comprises the steps of combining the various components to form the cleanser composition.

The present invention also contemplates methods for cleaning hard surfaces or removing soil in a manner believed obvious from the preceding description. However, to assure a complete understanding of the invention, such a method is carried out by contacting the surface, stain or soil with a composition according to the present invention. Thereafter, the composition together with the suspended stain is preferably removed from the surface by rinsing.

Accordingly, there has been disclosed above a number of embodiments and examples for a thickened aqueous abrasive cleanser particularly characterized by a smoothly flowable or plastic consistency while demonstrating the ability to suspend solids, preferably in the form of abrasives. While preferred embodiments and examples of the invention have been illustrated and described above, it is to be understood that these embodiments are capable of further variation and modification; therefore, the present invention is not to be limited to precise details of the embodiments set forth above but is to taken with such changes and variations as fall within the purview of the following claims.

What is claimed is:

1. An aqueous hard surface abrasive scouring cleanser characterized by compliance with environmental requirements for being substantially free of phosphate components, comprising:

(a) a colloidal alumina thickener having an average particle size, in dispersion, of no more than about one micron, the colloidal alumina thickener forming about one to fifteen percent by weight of the cleanser;

(b) a non-phospate electrolyte/buffer forming about 1 to 25 percent by weight of the cleanser;

(c) a surfactant system including two surfactant components, one surfactant component comprising a fatty acid anionic surfactant, the other surfactant component comprising a selected bleach-stable surfactant, the surfactant system forming about 0.1 to 15% by weight of the cleanser;

(d) a halogen bleach forming about 0.1 to 5 percent of the cleanser;

(e) a particulate abrasive having an average particle size of about one to as much as 400 microns to provide scouring action, the particulate abrasive forming about 5 to 70 percent by weight of the cleanser.

2. The cleanser of claim 1 wherein the colloidal alumina thickener has a maximum particle size in dispersion of no more than about 0.1 micron.

3. The cleanser of claim 1 wherein the electrolyte/-buffer is a silicate.

4. The cleanser of claim 1 wherein the electrolyte/-buffer is a carbonate material.

5. The cleanser of claim 1 wherein the fatty acid anionic surfactant component is monovalent.

6. The cleanser of claim 1 wherein the selected bleach-stable surfactant component is an amine oxide nonionic surfactant.

7. The cleanser of claim 1 wherein the selected bleach-stable surfactant component comprises a mixture of anionic and nonionic surfactants.

8. The cleanser of claim 7 wherein the anionic surfactant is a secondary alkane sulfonate and the nonionic surfactant is an amine oxide.

9. The cleanser of claim 1 wherein the selected bleach-stable surfactant component is selected from the group consisting of anionic, nonionic, amphoteric, zwitterionic surfactants, and mixtures thereof.

10. The cleanser of claim 1 wherein the selected bleach-stable surfactant component comprises an anionic surfactant selected from the group consisting of alkali metal sulfates, secondary alkane sulfonates, linear alkyl benzene sulfonates, and mixtures thereof.

11. The cleanser of claim 1 wherein the particulate abrasive comprises silica sand having an average particle size of about one to 400 microns.

12. A thickened aqueous cleanser characterized by a consistency which remains smoothly flowable or plastic, comprising:

(a) a colloidal alumina thickener having an average particle size, in dispersion, of no more than about one micron, the colloidal thickener forming about 1 to 15 percent by weight of the cleanser;

(b) an abrasive having an average particle size of about one to 400 microns to provide scouring action, the abrasive forming about 5 to 70 percent by weight of the cleanser;

(c) an electrolyte/buffer forming about 1 to 25 percent by weight of the cleanser; and (d) a fatty acid anionic surfactant forming about 0.1 to 5 percent by weight of the cleanser.

13. The cleanser of claim 12 wherein the electrolyte/-buffer is a silicate.

14. The cleanser of claim 12 wherein the electrolyte/-buffer is a carbonate material.

15. The cleanser of claim 12 wherein the fatty acid anionic surfactant component is monovalent.

16. The cleanser of claim 12 further comprising a halogen bleach and the fatty acid anionic surfactant is a saturated soap selected for maintaining bleach stability in the cleanser.

17. The cleanser of claim 16 further comprising an additional selected bleach-stable surfactant component.

18. The cleanser of claim 17 wherein the selected bleach-stable surfactant component is selected from the group consisting of anionic, nonionic, amphoteric, zwitterionic surfactants and mixtures thereof.

19. The cleanser of claim 17 wherein the selected bleach-stable surfactant component comprises an anionic surfactant selected from the group consisting of alkali metal sulfates, secondary alkane sulfonates, linear alkyl benzene sulfonates, and mixtures thereof.

20. The cleanser of claim 17 wherein the selected bleach-stable surfactant component is an amine oxide nonionic surfactant.

21. The cleanser of claim 17 wherein the selected bleach-stable surfactant component comprises a mixture of anionic and nonionic surfactants.

22. The cleanser of claim 21 wherein the anionic surfactant is a secondary alkane sulfonate and the nonionic surfactant is an amine oxide.

23. The cleanser of claim 12 further comprising an additional surfactant component selected from the group consisting of anionic, nonionic, amphoteric, zwitterionic surfactants, and mixtures thereof.

24. The cleanser of claim 12 further comprising an additional anionic surfactant selected from the group consisting of alkali metal sulfates, secondary alkane sulfonates, linear alkyl benzene sulfonates, and mixtures thereof.

25. The cleanser of claim 12 further comprising an amine oxide nonionic surfactant.

26. The cleanser of claim 12 further comprising an additional surfactant component, the additional surfactant component comprising a mixture of anionic and nonionic surfactants.

27. The cleanser of claim 26 wherein the anionic surfactant is a secondary alkane sulfonate and the nonionic surfactant is an amine oxide.

28. A method for cleaning hard surfaces comprising the steps of:

contacting the hard surface having a stain thereon with a hard surface abrasive scouring cleanser which comprises:

(a) a colloidal alumina thickener having an average particle size, in dispersion, of no more than about one micron, the colloidal alumina thickener forming about 1 to 15 percent by weight of the cleanser;

(b) an electrolyte/buffer forming about 1 to 25 percent by weight of the cleanser;

(c) a surfactant system including two surfactant components, one surfactant component comprising a fatty acid anionic surfactant, the other surfactant component comprising a selected bleach-stable surfactant, the surfactant system forming about 0.1 to 15 percent by weight of the cleanser;

(d) a halogen bleach forming about 0.1 to 5 percent by weight of the cleanser; and (e) a particulate abrasive having an average particle size of about one to as much as 400 microns to provide scouring action, the particulate abrasive forming about 5 to 70 percent by weight of the cleanser; and removing the cleanser and stain from the hard surface.

29. A method for preparing a hard surface abrasive scouring cleanser comprising the step of combining:

(a) a colloidal alumina thickener having an average particle size, in dispersion, of no more than about one micron, the colloidal alumina thickener forming about 1 to 15 percent by weight of the cleanser;

(b) an electrolyte/buffer forming about 1 to 25 percent by weight of the cleanser;

(c) a surfactant system including two surfactant components, one surfactant component comprising a fatty acid anionic surfactant, the other surfactant component comprising a selected bleach-stable surfactant, the surfactant system forming about 0.1 to 15 percent by weight of the cleanser;

(d) a halogen bleach forming about 0.1 to 5 percent by weight of the cleanser; and (e) a particulate abrasive having an average particle size of about one to as much as 400 microns to provide scouring action, the particulate abrasive forming about 5 to 70 percent by weight of the cleanser.

30. A method for cleaning with a thickened, aqueous cleanser characterized by a consistency which remains generally continuously flowable or plastic, comprising the steps of:

contacting a hard surface having a stain thereon with the thickened, aqueous cleanser comprising:

(a) a colloidal alumina thickener having an average particle size, in dispersion, of no more than about one micron, the colloidal alumina thickener forming about 1 to 15 percent by weight of the cleanser;

(b) an abrasive having an average particle size of about one to as much as 400 microns to provide scouring action, the abrasive forming about 5 to 70 percent by weight of the cleanser;

(c) an electrolyte/buffer forming about 1 to 25 percent by weight of the cleanser; and (d) a fatty acid anionic surfactant forming about 0.1 to 5 percent by weight of the cleanser; and removing the cleanser and stain from the surface.

31. The method of claim 30 wherein the electrolyte/-buffer comprises a silicate.

32. The method of claim 30 wherein the electrolyte/-buffer comprises a carbonate material.

33. A method for preparing a thickened, aqueous cleanser characterized by a consistency which remains generally continuously flowable or plastic, comprising the step of combining:

(a) a colloidal alumina thickener having an average particle size, in dispersion, of no more than about one micron, the colloidal alumina thickener forming about 1 to 15 percent by weight of the cleanser;

(b) an abrasive having an average particle size of about one to as much as 400 microns to provide scouring action, the abrasive forming about 5 to 70 percent by weight of the cleanser;

(c) an electrolyte/buffer forming about 1 to 25 percent by weight of the cleanser; and (d) a fatty acid anionic surfactant forming about 0.1 to 5 percent by weight of the cleanser.

34. The method of claim 33 wherein the electrolyte/-buffer is selected from the group consisting of silicate and carbonate materials.

* * * * *

UNITED STATES PATENT AND TRADEMARK OFFICE

CERTIFICATE OF CORRECTION

PATENT NO. : 4,695,394

DATED : September 22, 1987

INVENTOR(S) : Clement K. Choy et al

It is certified that error appears in the above—identified patent and that said Letters Patent is hereby corrected as shown below:

On the title page and at the head of column 1, change the title to read — AQUEOUS HARD SURFACE ABRASIVE CLEANSER —.

In column 1, line 42, change "cleansers" to -- cleaners --.
In column 2, line 31, change "now" to — nor —.
In column 2, line 46, change "hypochloride" to -- hypochlorite --.
In column 9, line 36, change "critera" to — criteria —.
In column 9, line 59, change "for" to -- from --.
In column 12, line 8, change "characteristics" to -- characteristic —.
In column 13, line 39, change "combined" to -- combine --.
In column 22, line 26, change "EXAMPLE 190 16" to — EXAMPLE #16 —.
In column 24, line 24 (Claim 1), change "non-phospate" to -- non-phosphate --

Signed and Sealed this

Nineteenth Day of April, 1988

*Attest:*

*Attesting Officer*

DONALD J. QUIGG

*Commissioner of Patents and Trademarks*